United States Patent [19]

Lyon

[11] 4,178,680

[45] Dec. 18, 1979

[54] WIRE WRAPPING DEVICE INCORPORATING RELEASABLE BIT LOCKING MECHANISM CONTROLLED BY INSERTION DEPTH OF TERMINAL

[75] Inventor: Jarrel D. Lyon, Oklahoma City, Okla.

[73] Assignee: Western Electric Company, Inc., New York, N.Y.

[21] Appl. No.: 885,929

[22] Filed: Mar. 13, 1978

[51] Int. Cl.[2] ..... B21F 15/00; B21F 3/04

[52] U.S. Cl. ..... 29/751; 140/124

[58] Field of Search ..... 29/751, 753; 72/135, 72/142; 140/119, 122, 124; 242/7.06, 7.17, 7.18

[56] References Cited

U.S. PATENT DOCUMENTS

| | | | |
|---|---|---|---|
| 2,635,819 | 4/1953 | Bennett | 242/7.17 |
| 2,688,449 | 9/1954 | Haagensen | 242/7.17 |
| 2,927,741 | 3/1960 | Moore et al. | 140/122 X |
| 3,023,484 | 3/1962 | Arens et al. | 29/751 X |
| 3,098,615 | 7/1963 | Bach et al. | 242/7.17 |
| 3,670,784 | 6/1972 | Ackerman | 140/124 X |
| 3,701,367 | 10/1972 | Ackerman | 140/119 |
| 3,882,906 | 5/1975 | Steiner et al. | 140/124 |
| 3,893,491 | 7/1975 | Jackson et al. | 140/122 |
| 4,036,268 | 7/1977 | Ward | 140/124 |

*Primary Examiner*—Ervin M. Combs
*Attorney, Agent, or Firm*—K. R. Bergum

[57] ABSTRACT

Several wire wrapping device embodiments are disclosed, each of which incorporates a releasable bit-locking mechanism associated with the bit-sleeve assembly thereof. The locking mechanism is mounted on the stationary sleeve of the device, and is actuated to responsively effect the release of the bit for rotation, prior to each successive wire wrap operation, only upon a terminal to be wire wrapped being inserted to a predetermined, but adjustable, depth within a terminal-receiving recess formed in the forward end of the bit. Such a mode of operation insures that each wire wrap is accurately positioned on each successive terminal. The bit-locking mechanism also may be optionally employed to responsively actuate an associated switch to either directly, or conditionally (i.e., in conjunction with the actuation of a power source-connected trigger switch), effect the energization of the drive motor coupled to the bit of a wire wrapping device.

26 Claims, 14 Drawing Figures

TO POWER SOURCE
BIT DRIVE MOTOR

WIRE WRAPPING DEVICE INCORPORATING RELEASABLE BIT LOCKING MECHANISM CONTROLLED BY INSERTION DEPTH OF TERMINAL

FIELD OF THE INVENTION

This invention relates to power-operated wire wrapped devices and, more particularly, to such a device having a releasable bit locking mechanism that is controlled by the adjustable depth of insertion of a terminal within a forward end bore of the bit.

DESCRIPTION OF THE PRIOR ART

In either pneumatically or electrically operated wire wrap devices of the hand-held gun type, for wrapping wire onto electrical terminals, an elongated, rotatable, power-driven bit is supported within a stationary sleeve that forms part of the device housing. At least the forward end of the bit is typically provided with an axially disposed bore or recess for receiving a terminal therein, with an elongated peripheral groove disposed in parallel and spaced relation to the bore so as to receive the end portion of the wire which is to be wrapped around each terminal. One or more notches are normally formed in the forward peripheral end of the sleeve so as to provide a temporary anchor for the wire at the point therealong where it exits the bit groove, and is bent substantially perpendicularly thereto. In operation, as the bit is rotated, the section of wire previously positioned within the groove thereof is progressively withdrawn as it is wrapped around the inserted terminal.

In many demanding wire wrap applications, such as involved in the wiring of complex backplanes, circuit boards and the like, utilized in specification-demanding electronic systems and equipment, it is often imperative that each wire wrap not only be effected with a requisite number of turns, but with such turns being accurately and consistently located a specified minimum distance from the outer end of each terminal. Such controlled wire wraps may be desired, for example, to allow respectively associated female connectors to be subsequently connected to the unwrapped end portions of the terminals.

To that end, it would be very desirous to have a solderless wire wrap device (or gun) wherein bit rotation is made dependent, in a simplified and inexpensive manner, not only on the actuation of the gun trigger, but on the adjustable depth of insertion of a terminal within a forward end bore of the bit. Several prior wire wrap devices have incorporated mechanisms for controlling the depth of insertion of a terminal within the bore of the bit. With such mechanisms, however, terminal insertion to any particular depth has generally not been made a condition for device operation. Even when this has been the case, however, the mechanism employed has not been applicable for use with both electrically and pneumatically operated wire wrap devices, nor has provision been made for the releasable locking of the bit from rotation, independently of the energization of the drive source, until a terminal has been inserted to an adjustable depth within the bit.

For example, L. E. Haagensen U.S. Pat. No. 2,688,449 discloses a wire wrap gun wherein an outwardly pneumatically biased bit, upon being inwardly displaced within an outer sleeve a fixed distance, in response to a terminal being inserted within a receiving bore of the bit, actuates an air valve, which, in turn, then supplies compressed air to an air motor so as to effect rotation of the bit. There is no mechanism in such a wire wrap gun, however, for locking the bit from rotation, not to mention in a manner that involves modification of only the detachable bit-sleeve assembly thereof, or that allows for the adjustment of the depth of terminal insertion within the bit and, hence, for control of the location along the terminal at which a wire wrap is formed.

R. E. Bennett U.S. Pat. No. 2,635,819 discloses a spring-biased displaceable rod, mounted for adjustable axial displacement within the bore of a bit, for controlling the depth of insertion of a terminal within the bit and, thereby, the location of a wire wrap on the terminal. The displacement of the rod, however, in no way is employed to responsively control the operation of the device per se.

J. C. Bach et al. U.S. Pat. No. 3,098,615, assigned to the same assignee as the present invention, discloses a spring-biased bit, the opposed force-displacement over a fixed distance being employed to prevent the overwrapping of wire on a terminal. Such a displaceable bit likewise in no way is employed to conditionally control the commencement of a wire wrap operation.

It is thus seen with respect to both of these last mentioned prior art devices, that neither of them either releasably locks the bit from rotation, or prevents the energization of the drive source until a given terminal has been positively inserted to a predetermined depth within the bit.

SUMMARY OF THE INVENTION

It, therefore, is an object of the present invention to provide a wire wrap device of either the pneumatically or electrically operated type, which incorporates a releasable bit locking mechanism of simplified, rugged and inexpensive construction, wherein bit rotation is made dependent not only on the normal actuation of the motor-energizing trigger, but on a predetermined, and adjustable, depth of insertion of a terminal within a forward end recess of the bit.

In accordance with the principles of the present invention, the above and other objects are realized in one preferred embodiment of a wire wrap device wherein a terminal-displaceable plunger, axially disposed and spring-biased within a bore of an elongated rotatable bit, is constructed such that the forward end thereof defines the base of a terminal-receiving recess in the bit, with a rearward section having a cam portion that is key-way guided along a slot formed in the wall of the bit. The cam portion is employed to controllably actuate an axially adjustable, and spring-biased bit-locking member. The locking member is mounted for reciprocal movement on a bit-supporting stationary sleeve, and has a portion thereof adapted to be continuously confined within a wall opening in the sleeve, and another portion adapted to be selectively and conditionally positioned within the slot of the bit, so as to releasably lock the latter to the sleeve.

Such locking action is initially effected only when the sleeve opening and the bit slot are brought into relative alignment, and with the bit being in a quiescent state, such as after each wire wrap operation. In most conventional wire wrap devices, the rotatable bit may be preadjusted so as to automatically be indexed to a desired angular position relative to the stationary sleeve. The spring-biased locking member, once cammed out of engagement with the bit slot, may be either manually or automatically reset so as to again effect the releasable locking of the bit to the sleeve, prior to each successive wire wrapping operation.

As thus described, it is seen that the actuable displacement of the locking member out of the rotatable bit slot is made dependent on, and is only responsive to, a terminal to be wire wrapped being inserted within the terminal-receiving bore or recess of the bit to a predetermined depth. In this manner each wire wrap, with a requisite number of turns, is consistently positioned a minimum distance from the outer end of each terminal. As such, an associated female connector, for example, may be readily connected to the unwrapped end region, of uniform length, of each terminal.

In accordance with another aspect of the invention, either a predetermined degree of displacement of the spring-biased plunger, or of the locking member, may be utilized to actuate a non-trigger responsive switch incorporated in the power source circuit of the device. Such a switch, which may comprise a microswitch for an electrically operated wire wrap device, or a pneumatic valve for an air driven device, would insure that the motor could not be energized until the bit was released for rotation. It is appreciated, of course, that such switches are optional, because in most conventional wire wrap devices the drive motors therefor have overload protection circuitry and/or slip clutches associated therewith.

DETAILED DESCRIPTION OF THE INVENTION

Figures 1, 2, 3:
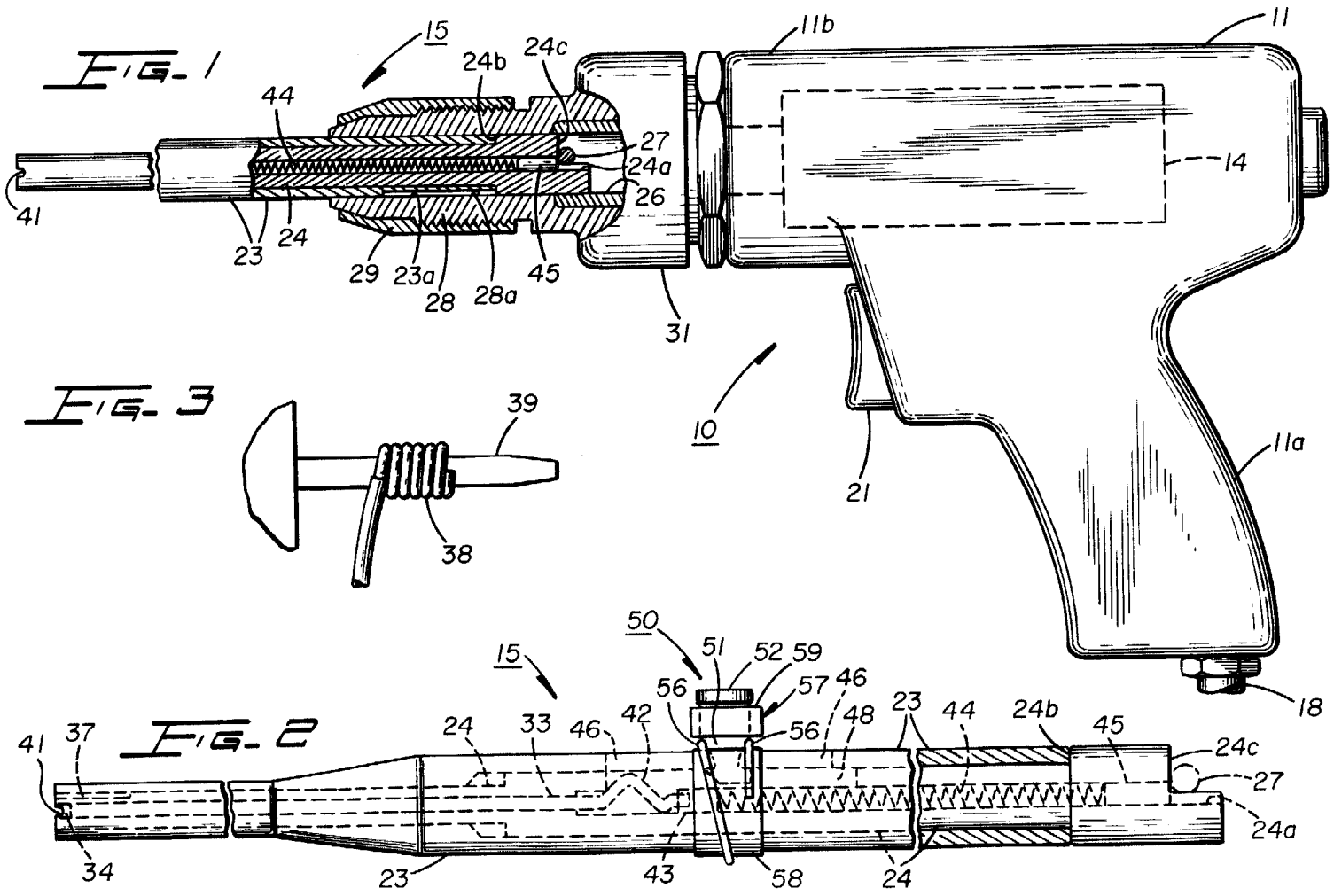
FIG. 1 is a side elevational view, partially in section, of one preferred wire wrap device, of the gun-shaped type, embodying the principles of the present invention.
FIG. 2 is an enlarged, detail view, partially in section, of the bit, sleeve and locking mechanism embodied in the wire wrap device of FIG. 1.
FIG. 3 is an enlarged, fragmentary view of several turns of wire wrapped onto an electrical terminal at a predetermined location therealong, as controlled through the use of the wire wrap device of FIG. 1.

With particular reference first to FIG. 1, a wire wrapping device 10 comprises a housing 11 which, for purposes of illustration, encloses a conventional air-driven motor shown only symbolically in phantom by reference numeral 14. The housing 11 includes a gun-shaped handle portion 11*a*, and a forward nose portion 11*b* which supports a bit-sleeve sub-assembly identified generally by the reference numeral 15. The motor 14 is energized by compressed air supplied through a flexible air line 18, under the control of a trigger 21. The latter, through a conventional linkage (not shown) actuates a suitable air valve (also not shown) associated with the motor.

Extending forwardly from and secured to the housing 11, as part of the wire wrap sub-assembly 15, is an elongated sleeve 23 within which is mounted a cylindrical rotatable bit 24. The rearward end of the bit is coupled to the forward end of a cylindrical driver 26 which, in turn, is coupled to the drive shaft (not shown) of the motor 14. Driving engagement between the bit 24 and driver 26 is effected between an undercut flat 24*a* formed in the bit, and a drive pin 27, the latter extending across and secured at opposite ends to the wall of the driver.

The inner end of the sleeve 23 is secured to the gun housing through a split chuck 28, a threaded nut 29 and a threaded collet 31. Such securement of the sleeve is effected after the insertion of the bit 24 within the sleeve. The sleeve 23 and sleeve holder 28 are keyed to each other by an integral key 28*a* of the latter communicating with a key slot 23*a* formed in the sleeve. The inner peripheral end of the sleeve 23, which engages a shoulder 24*b* of the bit, and a shoulder 24*c* of the bit, which engages the drive pin 27, prevents any displacement of the rotatable bit 24 relative to the sleeve in an axially direction.

The bore 24*d* of the bit 24, at its forward end, in conjunction with a spring-biased plunger 33, described in greater detail hereinbelow, define an axially disposed recess 34 of variable length (see FIG. 2), for receiving a terminal 39 (see FIG. 3). The bit is also formed with a longitudinally disposed groove 37 along a forward end region thereof, which groove is in parallel and spaced relationship relative to the recess 34. The groove 37 is dimensioned to receive a free end portion of a wire to be subsequently wrapped on a terminal, such as a wire 38 shown wrapped on a typical electrical terminal 39 in FIG. 3. In order to facilitate such a wire wrapping operation, the forward peripheral end of the sleeve 23 is formed with at least one notch 41 within which the wire is nested, by an operator, prior to the wire being bent substantially perpendicularly relative to the sleeve in preparation for a wire wrapping operation.

Considering the plunger 33 now in greater detail, and with particular reference to FIGS. 4–7, it comprises an elongated rod-like element that is axially disposed within the bore of the cylindrical bit 24, with the exception of a rearward V-shaped cam portion 42 defined by two offset bends which form oppositely inclined segments 42*a*, 42*b*. The rearward segment 42*b* functions as a cam to effect the release of the initially rotatably locked bit 24 relative to the stationary sleeve 23, as will be more fully described hereinafter.

The forward end of the plunger 33, as previously mentioned, defines the base of the terminal-receiving recess 34, and is axially displaced as a result of the rearward end of the plunger engaging a spring retainer or plug 43, such as within a preferably loose-fitting recessed bore of the latter. The plug, of circular cross-section, is dimensioned so as to freely displaceable axially within the bore of the bit 24. The forward end of a coil spring 44 abuts against the rearward side of the plug 43, and the rearward end of the spring abuts against a plug 45 which, in turn, abuts against the drive pin 27.

In accordance with an aspect of the invention, the stationary sleeve 23 is formed with a longitudinally disposed opening 46 along an intermediate region thereof, with the bit 24 being formed with a longitudinally disposed slot 48 that is located so as to allow the periodic alignment of the bit slot with the sleeve opening. The bit slot 48 is dimensioned so as to function as a key-way for the V-shaped cam portion 42 of the plunger. The latter, as thus mounted and guided, may be readily axially displaced relative to the bit 24 over an appreciable distance, the limits of which may be dictated, for example, by the maximum allowable compressive displacement of the biasing coil spring 44, or by the length of the bit slot 48, within which the cam portion 42 of the plunger is key-way guided, as is the case in the first illustrative embodiment. It is appreciated, of course, that a separate adjustable stop (or stops) could also be employed to limit the maximum displacement of the plunger relative to the bit and sleeve. For example, a coaxially mounted stop member could be adjustably mounted on the plunger on either one or both sides of the cam portion 42 thereof, with the cross-sectional dimension of each stop member, and the length of the bit slot, both being chosen such that each stop member, after a predetermined displacement of the plunger 33, would abut against the associated end wall of the bit slot. In that regard, the retainer plug 43 could readily be dimensioned, if desired, so as to also function as such a stop member.

Also in accordance with the principles of the present invention, a bit locking mechanism 50 is uniquely associated with the sleeve 23, bit 24, and spring-biased plunger 33. Considered more specifically, the locking mechanism 50 includes a spring-biased locking member 51 that is oriented perpendicularly to the sleeve and bit, and has a button-shaped top portion 52, an intermediate portion 53 that continuously communicates with the longitudinally disposed sleeve opening 46, and a lower portion 54 that is adapted to selectively communicate with the longitudinally disposed bit slot 48.

It should be noted at this point that the particular position of the locking mechanism 50 along the sleeve opening 46 controls the depth to which a terminal 39 must be inserted within the forward end bore 24*d* of the bit 24 before the latter is released for rotation.

Figure 4:
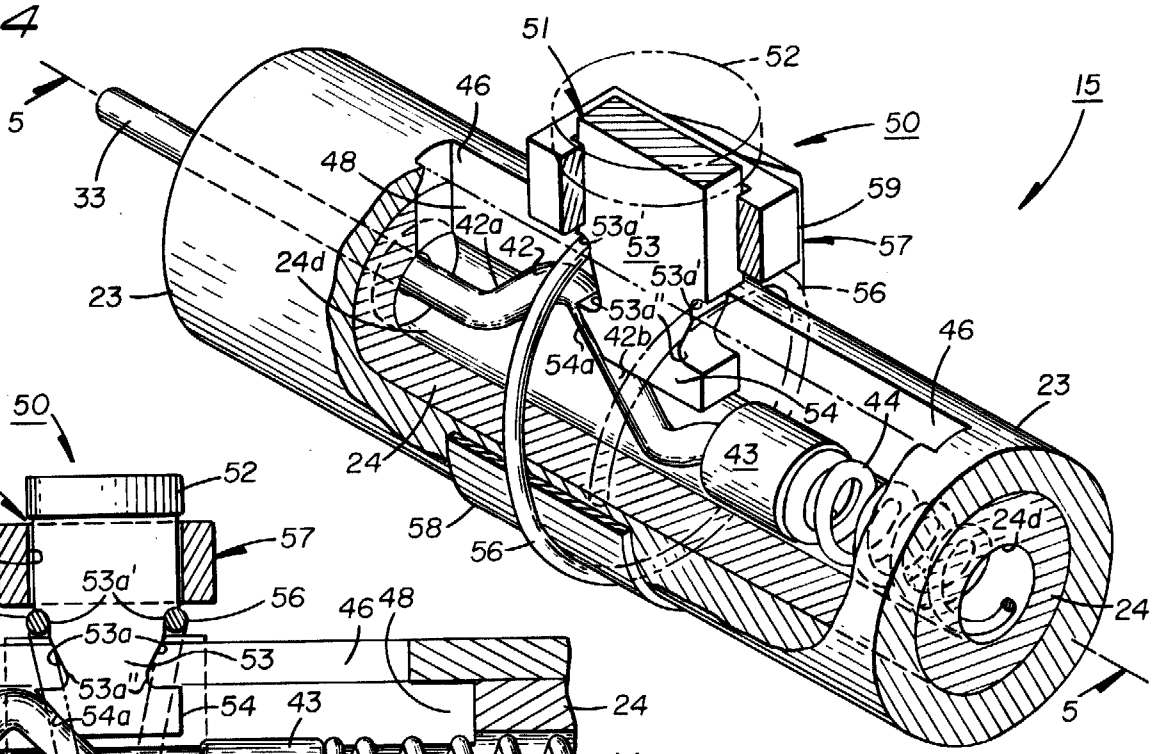
FIG. 4 is an enlarged, fragmentary, perspective view, partially broken away, illustrating portions of the bit, sleeve, plunger and locking mechanism embodied in the device of FIG. 1, with the bit being shown in a releasably locked position.
Figure 5:
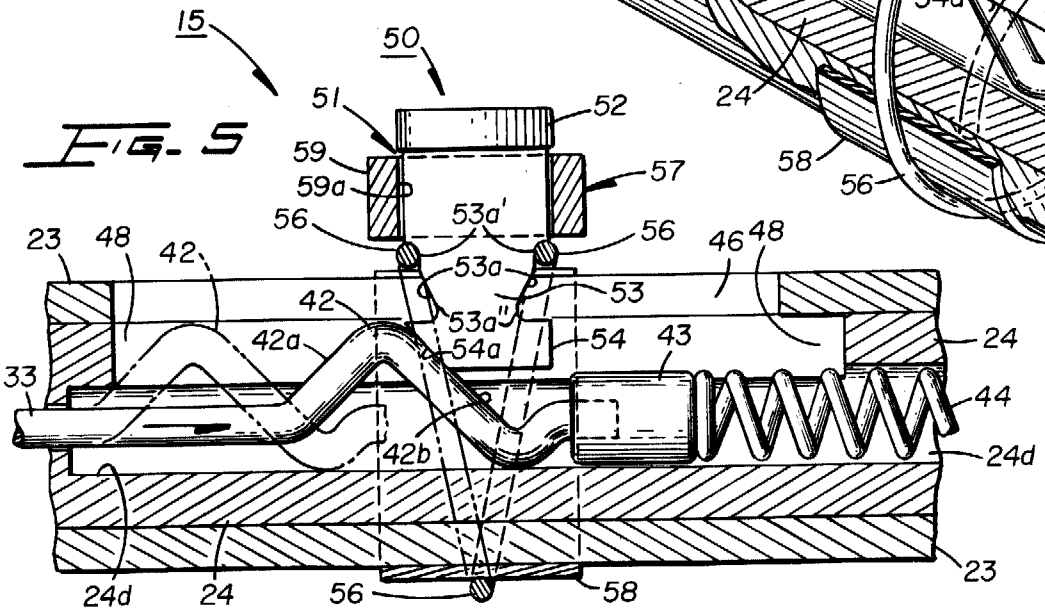
FIG. 5 is an enlarged, fragmentary, side elevational view, in section, taken along the line 5—5 of FIG. 4, with the position of the spring-biased plunger, relative to the locking mechanism, bit and sleeve, also being shown, in phantom, in its normal, fully extended, bit-locking position.

The lower portion 54 of the locking member 51, as best seen in FIGS. 4–7, is formed with a cam surface 54*a*, the latter being biased against the mating cam-defining segment 42*b* of the plunger 33 only when the bit 24 is about to be released for rotation from its locked position, as depicted in FIGS. 4 and 5. With no terminal inserted into the bit recess, the spring 44 would normally bias the plunger 33 to the left, as viewed in FIG. 5, to the bit-locking position shown in phantom, whereat the cam segment 42*a* of the plunger 33 also functions as a keyed stop, by abutting against the forward end of the bit slot 48. While in a bit-locking position, not only does the intermediate portion 53 of the locking member 51 extend through the elongated opening 46 in the sleeve 23, but the lower portion 54 of the locking member, including the cam surface 54*a* thereof, extends into the then aligned bit slot 48 formed through the wall of the bit 24. As such, the bit is releasably locked to the stationary outer sleeve by the mutually engaging locking member 51 of the locking mechanism 50.

It is necessary in order to effect such locking action that the sleeve opening 46 and the bit slot 48 be brought into alignment after each wire wrap operation. To this end, a conventional bit indexing mechanism (not shown), incorporated in the motor drive assembly of most wire wrapping devices, is employed to automatically effect the desired periodic re-alignment between the bit and sleeve each time the motor is de-energized.

As also seen in FIGS. 4–7, the intermediate region 53 of the locking member 51 is formed with two mutually disposed and tapered sidewalls 53*a* which terminate at their respective upper ends in undercut shoulders 53*a*', and at their respective lower ends in arcuate regions 53*a*''. A two-turn coil spring 56 is coaxially mounted on the sleeve 23, with adjacent turns of the coil spring being respectively and compressively positioned within the upper undercut shoulders 53*a*' of the locking member when the latter is in its bit-locking position, as depicted in FIGS. 2, 4 and 5.

Figure 7:
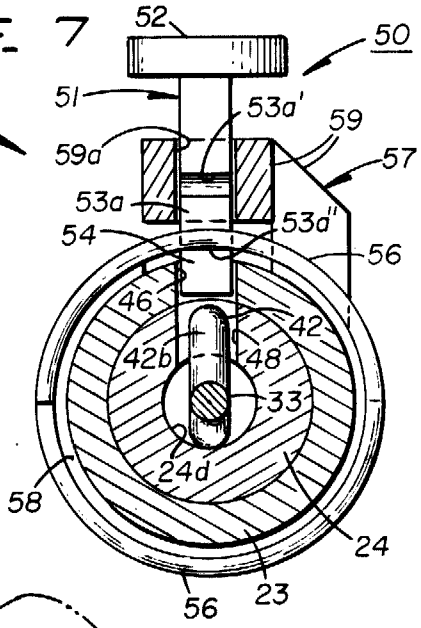
FIG. 7 is a cross-sectional view, taken along the line 7—7 of FIG. 6, showing the angular relationship of the bit and sleeve relative to the cam portion of the spring-biased plunger and the locking member, while the latter is in its bit-releasing position.
Figure 6:
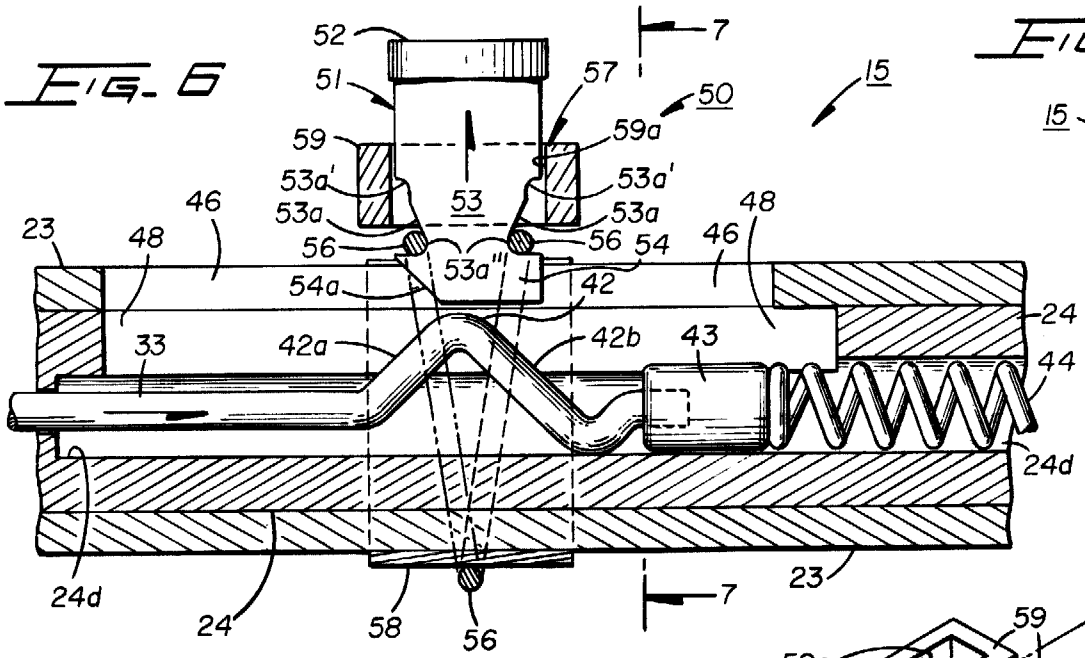
FIG. 6 is an enlarged, fragmentary, side elevational view, in section, similar to that of FIG. 5, but distinguishing therefrom by the plunger having been axially displaced within the bit a predetermined distance so as to cause the spring-biased locking member to be cammed out of engagement with the slot in the bit and, thereby, release the latter for rotation.

Upon the locking member 51 being partially cammed upwardly through the sleeve opening 56, as a result of the cam segment 42*b* of the cam portion 42 of the plunger 33 engaging and displacing the cam-follower surface 54*a* of the locking member, the adjacent turns of the coil spring 56 are displaced out of the upper undercut shoulders 53*a'* of the locking member. Thereafter, the adjacent turns commence to move along the tapered locking member sidewalls 53*a* until they are nested in the lower associated arcuate regions 53*a''*, as depicted in FIGS. 6 and 7. During such displacement, the coil spring is seen to cooperate with the camming action of the plunger 33 so as to effect a rapid, upward displacement of the locking member 51 to its bit-releasing position. As a result of such upward displacement, the lower portion 54 of the locking member, including the cam-follower surface 54*a* thereof, is displaced completely out of the bit slot 48 which, of course, releases the bit for rotation.

Until again reset, the locking member 51 is maintained in its uppermost bit-releasing position, i.e., out of engagement with the bit slot 48, as a result of the adjacent turns of the coil spring 56 remaining, under compressive force, within the lower respectively associated arcuate regions 53'' of the locking member. The locking member 51 is reset after a wire wrapping operation, from its bit-releasing position, depicted in FIGS. 6 and 7, to its bit-locking position, depicted in FIGS. 2, 4 and 5, by an operator simply depressing the upper button portion 52 of the locking member to its lowermost position. This is accomplished by exerting sufficient downward force on the locking member 51 to cause the adjacent turns of the coil spring 56 to be forced upwardly along the respectively associated tapered sidewalls 53*a* of the locking member until they are again nested in the upper terminating undercut shoulders 43*a'*, as best seen in FIGS. 4 and 5.

Figure 8:
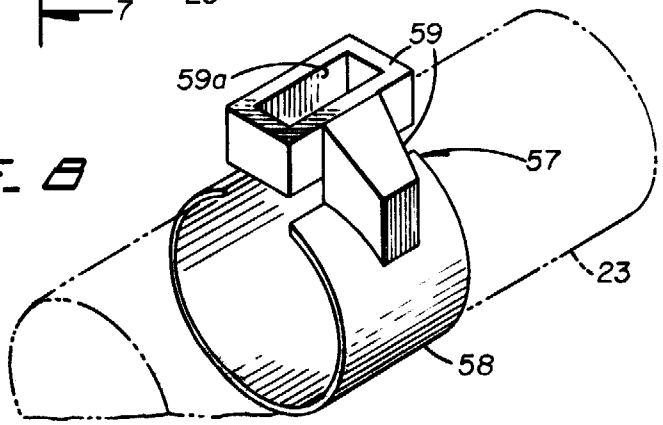
FIG. 8 is an enlarged, perspective view of the locking mechanism housing utilized in the first preferred embodiment, as secured to the sleeve thereof, only partially shown and in phantom.

With particular reference now to FIG. 8, an optional support band 57, comprised of a resilient openended cylindrical portion 58, mounted coaxially on the sleeve 23, and an upper boss 59, formed with a rectangular opening 59*a* therein, is preferably employed to reliably position and facilitate the retractable movement of the locking member 51 between its bit-locking and bit-releasing positions. This is accomplished by the opening 59*a* in the support band being dimensioned to accommodate the intermediate portion 53 of the locking member 51 in close-fitting relationship. As such, the support band 57 insures that the retractable displacement of the locking member 51 is always substantially perpendicular to the bit and sleeve. The support band, of course, also insures that the composite locking mechanism 50 cannot be displaced longitudinally along the sleeve 23, unless intentionally moved for the purpose of making a terminal-insertion depth adjustment. The latter adjustment, of course, as previously mentioned, directly controls the location of the wire wrap on each terminal.

Figures 11, 12, 13, 14:
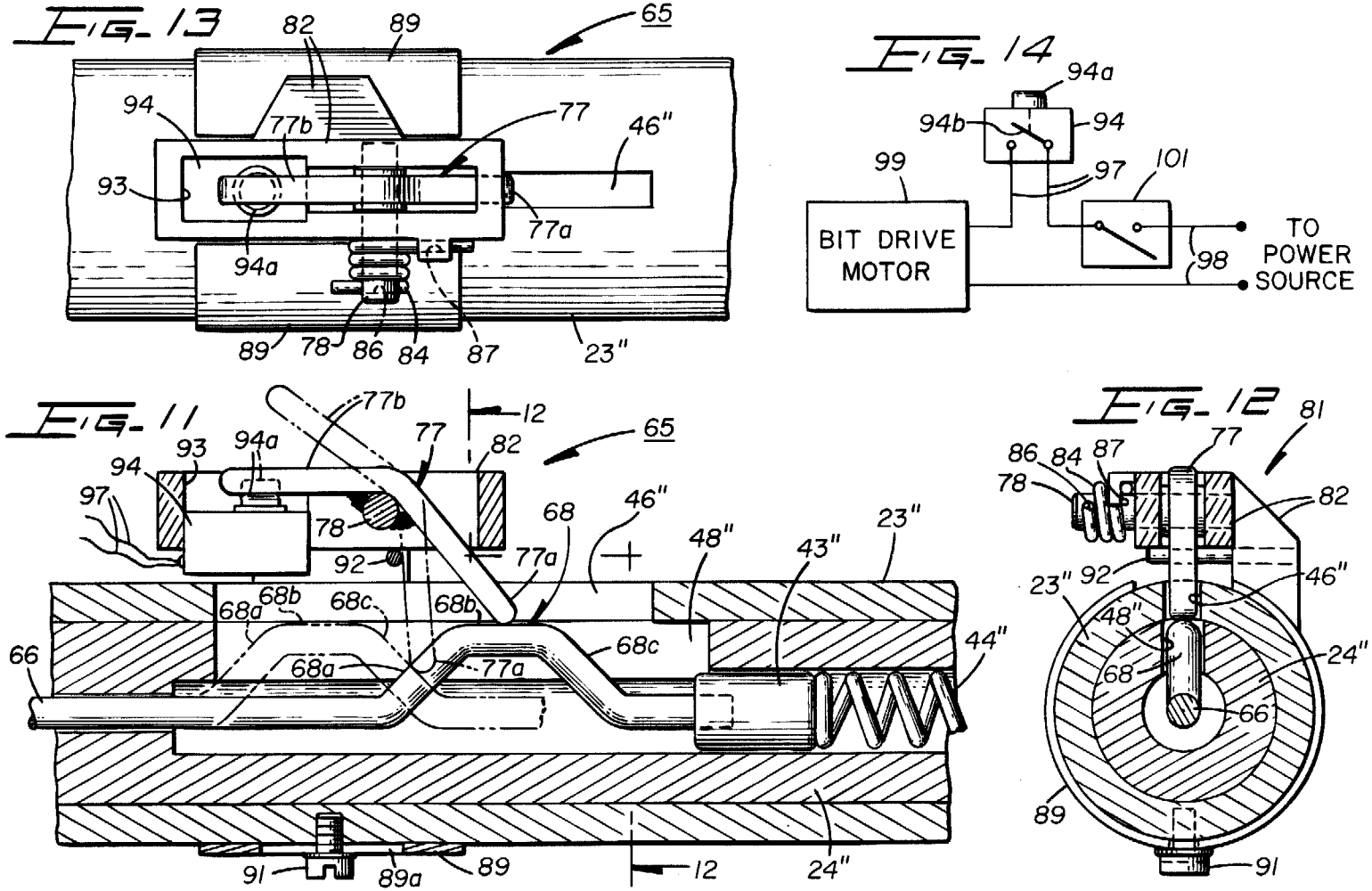
FIG. 11 is an enlarged, fragmentary, side elevational view, in section, illustrating a third preferred embodiment of the invention wherein a releasable bit locking mechanism is adapted to be automatically reset, to lock the bit from rotation, after each successive wire wrap operation in accordance with the principles of the present invention.
FIG. 12 is a cross-sectional view, taken along the line 12—12 of FIG. 11, illustrating, in particular, the angular relationship of the bit and sleeve relative to the cam portion of the spring-biased plunger and the automatically resettable locking member, while the latter is in its bit-releasing position.
FIG. 13 is a fragmentary, detail plan view, primarily of the locking mechanism and sleeve of FIG. 11, showing in greater detail the manner in which the locking member is pivotally mounted and spring-biased.
FIG. 14 is a simplified schematic diagram of a control circuit for an electrically operated wire wrapping device embodying the structural elements of FIG. 11, including the optional electrical switch which is actuated, so as to at least in part complete a circuit for energizing the drive motor of the device, only when a terminal has been inserted to a predetermined depth within the recess of the associated rotatable, but controllably locked bit.

The required degree of adjustable securement of the lower cylindrical portion 58 of the support band to the sleeve 23 may be effected not only by properly established resilient frictional contact therebetween, but by the use of a threaded fastening element. Such an element is depicted in FIG. 11 in connection with a third illustrative embodiment of the invention described hereinbelow. A suitable cement, such as an epoxy resin formulation, or a lacquer, could also be employed to secure the support band to the sleeve, but would normally be less desirable as the support band could not be as easily repositioned, even if the cement or lacquer were readily dissolvable by a solvent. For the purpose intended, the support band 57 may be made out of either a suitable metal, or a resinous plastic material.

In connection with the advantage of being able to adjust the locking mechanism 50 at different points along the sleeve opening, it should also be appreciated that two separate locking mechanisms 50, for example, could be prepositioned in tandem on the common sleeve 23. Such a pair of locking mechanisms would greatly facilitate the forming of either multiple wire wraps at different locations along a given terminal, or different wire wraps on different types or codes of terminals.

From the foregoing description of the structural elements forming the composite wire wrap gun 10, it is seen that the bit 25 is released for rotation, so as to effect a wire wrap on a given terminal 38 (see FIG. 3), in the following manner: Upon the initial insertion of a terminal 39 to the proper depth within the bore 24*d* of the bit 24, the plunger 33 is displaced to the right, as viewed in FIG. 2, thereby, overcoming the compressive force of the helical coil spring 44. Such axial displacement of the plunger, of course, likewise displaces the cam portion 42 thereof to the right, along the key-way guided slot 48 formed in the bit 24.

As thus displaced, the cam portion 42, in turn, causes the locking member 51 to be cammed upwardly through the sleeve opening 46 within which it is confined. During such upward displacement, the adjacent turns of the coil spring 56 are dislodged from the respectively associated undercut shoulders 53*a'* formed in the locking member 51. This results in the spring 56 facilitating the camming action initially imparted against the locking member 51 by the plunger cam portion 42, until the locking member has been completely withdrawn from the bit slot 48. Such release of the bit 24 for rotation, of course, depends solely on whether a given terminal 39 has been initially inserted to the requisite depth within the bore of the bit 24.

In connection with the terminal-initiated displacements of the plunger 33 and the locking member 51, either of such displacements may be further employed to optionally actuate a suitable switch, whether of the electrical or pneumatic valve type, incorporated in the power source circuit (not shown with respect to the first embodiment) of the wire wrapping device. A switch for that purpose, or any other desired purpose, is disclosed as optional in the third embodiment of the invention described hereinbelow.

Figure 9:
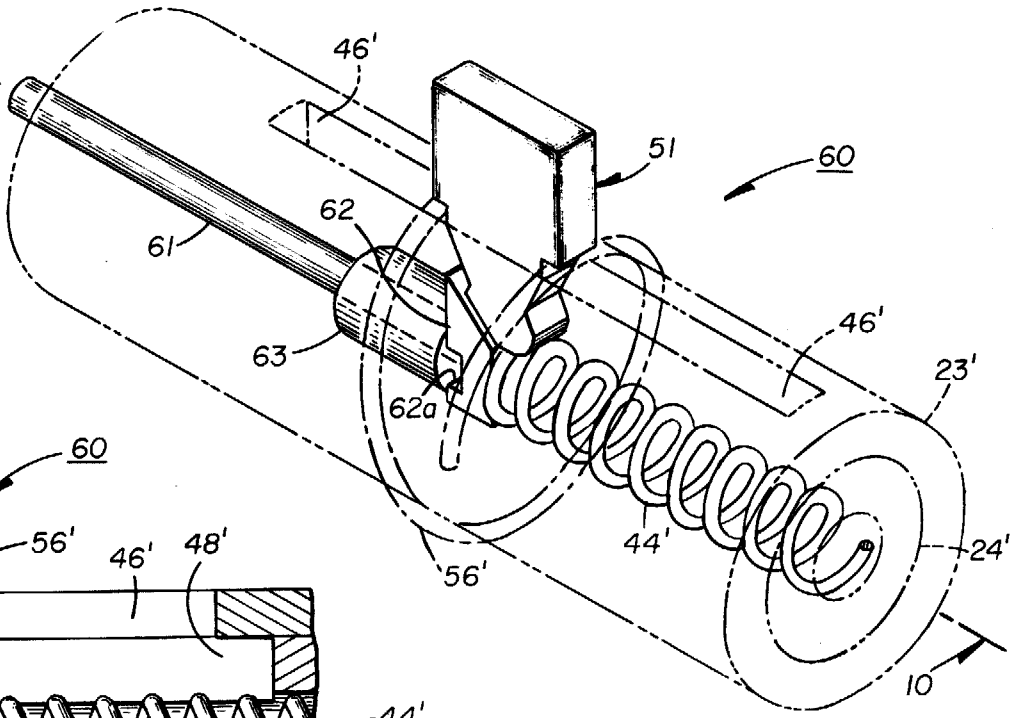
FIG. 9 is an enlarged, fragmentary, perspective view, partially in phantom, illustrating a second preferred embodiment of the invention wherein a separate cam member is secured to the inner end of a straight rod-shaped plunger to effect the desired responsive displacement of an associated locking member, of the type depicted in the first embodiment, and shown in its bit-locking position.
Figure 10:
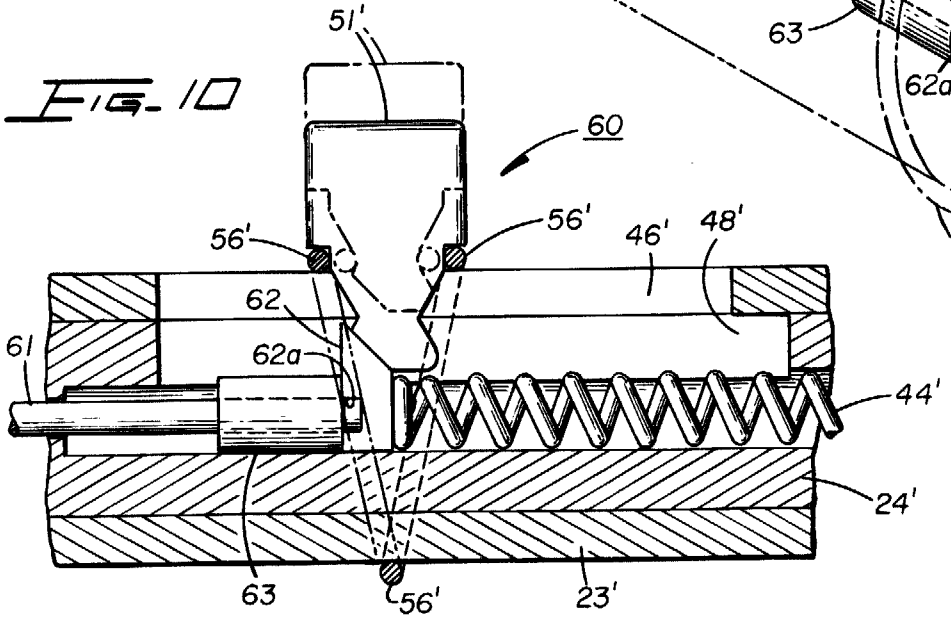
FIG. 10 is an enlarged, fragmentary side elevational view, taken along the line 10—10 of FIG. 9 with the structural elements being shown primarily in section, and with the locking member also being shown in phantom in its bit-releasing position.

FIGS. 9 and 10 illustrate a second preferred embodiment of the invention. The composite bit-sleeve subassembly 60, as shown, basically involves only a modification of the sub-assembly 15 of the first embodiment, distinguishing therefrom in the use of a straight rod-like plunger 61, with a separate cam member 62 engaging the inner end thereof. More specifically, the inner terminating end of the plunger 61 is preferably nested within a bore 62*a* of the cam member 62 so as to allow relative rotation therebetween, for reasons discussed herebelow. In all other respects, the separate cam member 62 functions in the same manner as the offset angular cam portion 42 formed as an integral part of the plunger 33 of the first embodiment, namely, to effect the displacement of an associated locking member 51' from its solid line bit-locking position, to its phantom line bit-releasing position, as shown in FIG. 10.

A collar 63 is fixedly, but preferably adjustably, mounted coaxially on the plunger 61 such that the cam member 62 is compressively interposed between the rearward end of the collar and the forward end of a biasing coil spring 44'. The abutting rearward surface of the collar 63 facilitates maintaining the cam member 62 in the desired orientation within the bit slot 48'. The forward end of the collar also may be employed, as illustrated, to function as an adjustable stop, when allowed to abut against the forward end wall of the bit slot 48'. As such, the collar 63 can readily be employed to control the maximum forward, spring-biased position of the plunger 61, relative to the bit 24', i.e., in the absence of a terminal having been inserted within the bore of the bit and biased against the plunger.

There are several possible advantages in utilizing a separate cam 62 in certain wire wrapping operations. For example, and as previously mentioned, such a cam allows the rotation of the bit 24' and cam member 62 relative to the plunger 61. A non-driven, or floating, plunger 61 would be less likely to damage or impair in some way the outer end of an engaging terminal to be wire wrapped, particularly if the latter was relatively fragile, and/or was gold plated so as to provide subsequent contact, for example, with an associated female type connector. In addition, a separate cam 62 allows for a wider choice of material therefor, based on cost, so as to optimize wearability. A separate cam also facilitates the accurate machining thereof for close-fit engagement within the keyway guiding bit slot. Finally, a separate cam member 62 can also facilitate the replacement thereof, through the bit slot, as compared to the replacement of the entire plunger rod, when formed with an integral cam portion, as in the first embodiment. All of these possible advantages, of course, are counterbalanced by the considerably simpler and less expensive plunger 33 formed with an integral cam portion, in the first embodiment. In all other respects, the bit-sleeve sub-assembly 60 is identical to the corresponding sub-assembly 15 illustrated and described in detail in connection with the first embodiment of the invention. As such, all of the other illustrated structural elements in the second embodiment of FIGS. 9 and 10 are identified by reference numerals respectively corresponding to those of the first embodiment, but primed.

While it is necessary in accordance with the principles of the first and second of the three preferred embodiments of the invention to manually push the locking member 51 (or 51') downwardly into engagement with the bit slot 46 (or 46') after each wire wrap operation, such manual resetting of the locking member is obviated in accordance with the third preferred embodiment of the invention, as illustrated in FIGS. 11–13. As the only modifications in third embodiment, as compared to the first embodiment, relate to the plunger and locking mechanisms, only those structural elements will be described in detail, with all of the other structural elements being identified by like, but double primed referenced numerals.

With particular reference first to FIG. 11, it is seen that a releasable bit-locking sub-assembly 65 includes a rod-like plunger 66, axially mounted within a cylindrical and rotatable bit 24'', and formed with an intermediate cam-defining portion 68. The latter comprises a forward offset angular segment **68*a*, an intermediate offset linear segment 68*b*, and a rearward offset angular segment 68*c*. These plunger segments 68*a–c* are located along the plunger 66 such that the intermediate linear portion 68*b* thereof is key-way guided within a longitudinally disposed slot 48'' of the bit 24''. To that end, the plunger 66 and the bit 24'' function in the same manner as the bit 24 and plunger 33** in the first embodiment.

An automatically resettable bit locking mechanism 75 in the third illustrative embodiment comprises a substantially L-shaped locking member 77 secured, such as by a weld, on a stub shaft 78. The latter is mounted on a support housing 81 and, in particular, on an upper laterally extending boss 82 thereof, best seen in FIG. 12.

A coil spring 84, best seen in FIGS. 12 and 13, is coaxially mounted on the shaft 78, with one terminating end portion thereof extending through a bore 86 formed through and near the end of the shaft 78. The opposite terminating end portion of the coil spring 84 nests within a notch 87 formed in the laterally extending boss 82 of the support housing 81. The coil spring 84 is wound such that it continuously biases the locking member 77, as well as the supporting stub shaft 78, in a clockwise direction, as viewed in FIG. 11. As such, a lower portion **77*a* of the locking member continuously engages the longitudinally disposed opening 46'' formed in the sleeve 23'', and selectively engages the bit slot 48'', such as while in the position shown in phantom in FIG. 11. In this latter position, the lower portion 77*a* of the locking member rests against a stop 92 secured to the support housing 81**.

The housing, in addition to the aforementioned boss 82, has a lower cylindrical portion 89 that compressively engages the outer wall of the sleeve 23''. After properly positioning the housing 81 relative to the longitudinally disposed bit slot 48'', the housing is rigidly, but adjustably, secured to the sleeve by means of a threaded fastening member 91, the latter extending through an adjustment slot **89*a* formed in the cylindrical housing portion 89, as best seen in FIG. 11. It is appreciated, of course, that a suitable cement, such as of an epoxy formulation, could be utilized for the same purpose. In the latter case, however, as previously mentioned, the locking mechanism 75 could not be as readily adjusted along the sleeve as with the fastening member 91**.

As illustrated in FIG. 11, with the plunger 66 in the position shown in solid line form, the bit 24'' is released for rotation. For this to happen, it is understood, of course, that a terminal (not shown) must have been inserted within the forward end recess of the bit (as described in connection with the first embodiment) such that the plunger 66 is displaced from the position shown in phantom, resting against the stop 92, to the position shown in solid line form. During such displacement of the plunger, the rearward offset segment **68*c* thereof functions as a cam to pivot the locking member 77 counter clockwise until the lower end portion 77*a* thereof is completely withdrawn from the bit slot 48''. When in this bit-releasing position, the lower end portion 77*a* of the locking member is in contact with the offset linear intermediate segment 68*b*** of the plunger.

As also seen in FIGS. 11 and 13, the laterally extending boss 82 of the locking mechanism housing 81 is also formed with a recessed area 93 within which an optional switch 94, such as a pneumatic valve, or a microswitch, as illustrated, is nested. The switch is shown, by way of example, positioned a predetermined distance beneath the upper portion **77*b* of the pivotal locking member 77 so as to be actuated thereby. More specifically, as illustrated, whenever the spring-biased plunger 66 is displaced inwardly within the bit by a distance sufficient to cause the cam segment 68*c* thereof to pivot the lower portion 77*a* of the locking member out of the bit slot 48'', the upper portion 77*b* of the locking member pivots downwardly in an arc until it contacts and, thereafter, displaces a switch plunger 94a by a sufficient amount to actuate the switch 94**.

FIG. 14 discloses one possible application of such a switch, by way of example, in an electrically operated wire wrapping device wherein the switch 94 is chosen to have a normally open contact 94b, and wherein the switch leads 97 associated therewith are connected in series in one of a pair of leads 98 associated with the electrical power circuit of an electrically operated wire wrapping device motor 99. With the switch 94 thus wired, it is seen that not only will the bit be mechanically locked to the sleeve in a releasable manner, in accord with the principles of this invention, but the bit-driving motor cannot even be energized by a trigger-actuated switch 101 to drive the bit, until a terminal has been inserted within the latter to a predetermined depth.

Such multiple conditional requirements for operating a wire wrap gun may be desirable, for example, in those cases wherein the motor of an electrically operated wire wrap device is not capable of withstanding even momentary overload conditions on a repetitious basis, such as in the case where the trigger could be actuated by an operator before the bit has been released for rotation, in response to a properly inserted terminal. In most conventional wire wrap guns of the electrically-operated type, however, either the motor has built-in overload protection circuitry, or is coupled to the bit through a conventional slip clutch. As such, the optional switch described would normally not be necessary.

With respect to air-operated wire wrapping devices, as previously mentioned, the microswitch 94 could readily be replaced, if desired, with a pneumatic control valve. Such an optional valve could similarly be serially incorporated in the main pneumatic power line, in a manner functionally similar to that depicted in FIG. 14, and made responsive to the pivotal movement of the locking member 77. While such an auxiliary control valve would not be necessary to protect an air-operated motor, such as from momentary overloads, it could be employed to replace the conventional trigger-actuated valve, if desired, in a given wire wrapping device and application therefor.

In connection with an optional switch, whether of either the electrical or pneumatic type, and regardless of the use intended therewith, it should be appreciated that the switch need not be mounted in the manner illustrated in FIG. 11, nor actuated in the same way. Rather, and by way of example only, such a switch could also be readily mounted directly on the outer stationary sleeve, or within the device housing, in any of the preferred embodiments, in such a way as to be selectively actuated by the displacement of the spring-biased plunger (including the cam associated therewith), or the locking member.

While several related and preferred wire wrapping devices incorporating releasable bit-locking mechanisms have been disclosed herein, it is obvious that various modifications may be made to the present illustrative embodiments of the invention, and that a number of alternative related embodiments may be devised, without departing from the spirit and scope of the invention.

I claim:

1. A wire wrapping device for wrapping a conductive wire around and in intimate contact with an electrical terminal at a controllable location therealong, said device comprising;

a main housing for said device;

actuable drive means mounted within said housing;

stationary sleeve means secured to said housing, and having an opening extending through the wall thereof;

bit means mounted within said sleeve means, and including a longitudinally disposed, rotatable cylindrical member adapted to be operably driven by said drive means, the forward end of said cylindrical member forming a terminal-receiving recess, the length of which is controlled by a bit means base-defining member that is spring-biased and displaceable in the axial direction over at least a predetermined distance within said cylindrical member, said latter member also including a longitudinally extending slot formed in the wall thereof, and positioned to selectively communicate with the opening in said sleeve means, and releasable locking means, including an actuably displaceable locking member, supported on said sleeve means, said locking member being adapted to have a portion thereof continuously positioned within the opening of said sleeve means, and another portion thereof selectively positioned within the slot of said cylindrical member, to lock the latter to the sleeve means, the actuable displacement of said locking member out of the cylindrical member slot being dependent on, and responsive to, a terminal to be wire wrapped being inserted within the terminal-receiving recess of said cylindrical member to a depth that causes the associated spring-biased, base-defining member to be displaced said predetermined distance.

2. A wire wrapping device in accordance with claim 1 wherein said drive means includes trigger-actuated energizing switch means, and wherein said bit-means base-defining member comprises an elongated rod-shaped plunger, with a cam portion located therealong to effect the displacement of said locking member out of the slot of said cylindrical member upon said plunger being displaced said predetermined distance.

3. A wire wrapping device in accordance with claim 1 further including switch means for at least in part enabling said drive means, said switch means being positioned so as to be responsively actuated by the insertion of a terminal within said cylindrical member to a depth that causes the associated base-defining member to be displaced said predetermined distance.

4. A wire wrapping device in accordance with claim 2 further comprising an adjustable locking member housing secured to the outer wall of said sleeve means, said housing member having a laterally extending boss formed with an aperture adapted to receive and guide the reciprocally displaceable locking member.

5. A wire wrapping device in accordance with claim 2 wherein said locking means further includes spring means associated with said locking member and said sleeve means, said spring means being adapted to cooperate with said plunger to displace said locking member out of engagement with the slot in said cylindrical member, and to maintain said locking member in such a dis-engaged position until a downward force is externally imparted against said locking member sufficient to overcome the then opposed biasing force exerted thereagainst by said spring means, said overcoming force causing said locking member to again be re-positioned in engagement with the slot of said cylindrical member, at which time said spring means produces no displaceable biasing force against said locking member.

6. A wire wrapping device in accordance with claim 2 wherein said locking means further includes spring means associated with said locking member for urging the latter, after having been displaced out of engagement with said cylindrical member slot by said plunger, back into engagement with said slot each time, and upon said slot being brought into alignment with said sleeve means opening, while said cylindrical member is in a quiescent state.

7. A wire wrapping device in accordance with claim 1, wherein said bit means further has a longitudinally disposed groove formed in the outer wall thereof, said groove extending rearwardly a predetermined distance from the terminal-receiving end of said bit means so as to receive a section of wire to be wire wrapped when said bit is rotatably mounted in a wire wrapping device, and wherein said bit means additionally has at least one wire-receiving notch formed in the forward terminal-receiving peripheral end thereof.

8. A wire wrapping device for wrapping a conductive wire around and in intimate contact with an electrical terminal at a controllable location therealong, said device comprising:

a main housing for said device;

actuable drive means mounted within said housing;

stationary sleeve means secured to said housing, and having a longitudinally disposed opening extending through the wall thereof, and located along an intermediate region thereof;

rotatable bit means mounted within said sleeve means, and operably driven by said drive means, said bit means having an axially disposed bore which defines, in part, a terminal-receiving recess, the axial length of which is variable, said bit means further including a longitudinally extending slot formed in the wall thereof, and positioned to be selectively aligned with the opening within said sleeve means;

resiliently biased plunger means, including a cam portion, axially mounted within the bore of said bit means, and being displaceable axially over at least a predetermined distance relative thereto, the forward end of said plunger means also defining the base of said terminal-receiving recess and, thus, determining the axial length thereof, and releasable locking means, including an actuably displaceable locking member, supported on said sleeve means, said locking member being adapted to have a portion thereof continuously positioned within the opening of said sleeve means, and another portion thereof, having a cam-follower surface, selectively positioned within the slot of said bit means, to lock the latter to the sleeve means, the release of said bit means for rotation being dependent on, and responsive to, a terminal to be wire wrapped being inserted within said bit means receiving recess to a depth that causes said plunger means to be longitudinally displaced said predetermined distance relative to said bit means, said displacement causing the cam portion of said plunger means to engage and displace the cam-follower surface of said locking member sufficiently to effect the displacement of the latter out of said bit means slot.

9. A wire wrapping device in accordance with claim 8 further comprising an adjustable locking member housing secured to the outer wall of said sleeve means, said housing member having a laterally extending boss formed with an aperture adapted to receive and guide the reciprocally displaceable locking member.

10. A wire wrapping device in accordance with claim 8 wherein said locking means further includes spring means associated with said locking member and said sleeve means, said spring means being adapted to cooperate with said plunger means to displace said locking member out of engagement with the slot in said bit means, and to maintain said locking member in such a dis-engaged position until a downward force is externally imparted against said locking member sufficient to overcome the then opposed biasing force exerted thereagainst by said spring means, said overcoming force causing said locking member to again be re-positioned in in engagement with the slot of said bit means, at which time said spring means produces no displaceable biasing force against said locking member.

11. A wire wrapping device in accordance with claim 10 wherein said plunger means comprises an elongated rod-shaped plunger, with said cam portion forming an integral part thereof, defined by at least two offset bends, and being key-way guided within the slot of said bit means.

12. A wire wrapping device in accordance with claim 10 wherein said plunger means comprises an elongated, axially disposed, rod-shaped plunger, with said cam portion comprising a member engaging the inner end of said plunger, and being key-way guided within the slot of said bit means.

13. A wire wrapping device in accordance with claim 8 wherein said locking member is formed with a mutually disposed pair of undercut shoulders that respectively merge into different inwardly and downwardly inclined sidewalls which, in turn, respectively terminate in different lower arcuate regions, and wherein said locking member is mounted between two adjacent turns of a helically wound spring, said spring being coaxially positioned on said sleeve means, with the two adjacent turns of said spring normally being respectively nested within said undercut shoulders of said locking member, but with said turns being dislodged from said shoulders and compressively biased against and moved along different ones of said inclined sidewalls of said locking member until said turns are each nested within a locking member with the cam-follower surface within the slot of said bit means after each wire wrap operation.

14. A wire wrapping device in accordance with claim 8 further including switch means positioned so as to be responsively actuated by the displacement of said locking member out of the slot of said bit means.

15. A wire wrapping device in accordance with claim 14 wherein said actuable switch means is serially connected in the power source circuit of said device for at least in part effecting the energization of said drive means.

16. A wire wrapping device comprising:

a main housing for said device;

actuable drive means mounted within said housing;

stationary sleeve means secured to said housing;

controllably driven rotatable bit means mounted within said sleeve means, said bit means defining a terminal-receiving recess formed in the forward end thereof, with said recess further being defined by a resiliently biased and axially displaceable base, and locking means, releasably responsive to a predetermined displacement of said terminal-receiving base, for preventing the rotation of said bit means until a terminal to be wire-wrapped has been inserted to a predetermined depth within the receiving recess of said bit means, said conditionally inserted terminal responsively causing the predetermined displacement of said terminal-receiving base so as to then effect the release of said bit means for rotation.

17. A wire wrapping device in accordance with claim 16 wherein said locking means further includes reset means to automatically re-lock said bit means from rotation after each wire wrapped terminal has been withdrawn from said receiving recess of said bit means.

18. A terminal-receiving and wire wrapping assembly adapted for use as a detachable part of a composite wire wrapping device, said assembly comprising:

stationary sleeve means;

bit means mounted within said sleeve means, and adapted to be rotatably driven, said bit means defining a terminal-receiving recess formed in the forward end thereof, with said recess further being defined by a resiliently biased and axially displaceable base, and locking means, releasably responsive to a predetermined displacement of said terminal-receiving base, for preventing the rotation of said bit means until a terminal to be wire-wrapped has been inserted to a predetermined depth within the receiving recess of said bit means, said conditionally inserted terminal responsively causing the predetermined displacement of said terminal-receiving base so as to then effect the release of said bit means for rotation.

19. A terminal-receiving and wire wrapping assembly in accordance with claim 18 wherein said locking means further includes reset means to automatically re-lock said bit means from rotation after each wire wrapped terminal has been withdrawn from said receiving recess of said bit means.

20. A terminal-receiving and wire wrapping assembly in accordance with claim 18 further including switch means mounted on said assembly so as to be responsively actuated by a terminal having been inserted to said predetermined depth within the receiving recess of said bit means.

21. A terminal-receiving and wire wrapping assembly adapted for use as an interchangeable part of a composite wire wrapping device, said assembly comprising:

stationary sleeve means having an opening extending through the wall thereof;

bit means mounted within said sleeve means, and including a longitudinally disposed, rotatable cylindrical member adapted to be operably driven, the forward end of said cylindrical member forming a terminal-receiving recess, the length of which is controlled by a bit means base-defining member that is spring-biased and displaceable in the axial direction over at least a predetermined distance within said cylindrical member, said latter member also including a longitudinally extending slot formed in the wall thereof, and positioned to selectively communicate with the opening in said sleeve means, and releasable locking means, including an actuably displaceable locking member, supported on said sleeve means, said locking member being adapted to have a portion thereof continuously positioned within the opening of said sleeve means, and another portion thereof selectively positioned within the slot of said cylindrical member, to lock the latter to the sleeve means, the actuable displacement of said locking member out of the cylindrical member slot being dependent on, and responsive to, a terminal to be wire wrapped being inserted within the terminal-receiving recess of said cylindrical member to a depth that causes the associated spring-biased, base-defining member to be displaced said predetermined distance.

22. A terminal-receiving and wire wrapping assembly in accordance with claim 21 wherein said bit-means base-defining member comprises an elongated rod-shaped plunger, with a cam portion located therealong to effect the displacement of said locking member out of the slot of said cylindrical member upon said plunger being displaced said predetermined distance.

23. A terminal-receiving and wire wrapping assembly in accordance with claim 22 wherein said locking means further includes spring means associated with said locking member and said sleeve means, said spring means being adapted to cooperate with said plunger to displace said locking member out of engagement with the slot in said cylindrical member, and to maintain said locking member in such a dis-engaged position until a downward force is externally imparted against said locking member sufficient to overcome the then opposed biasing force exerted thereagainst by said spring means, said overcoming force causing said locking member to again be re-positioned in engagement with the slot of said cylindrical member, at which time said spring means produces no displaceable biasing force against said locking member.

24. A terminal-receiving and wire wrapping assembly in accordance with claim 22 wherein said locking means further includes spring means associated with said locking member for urging the latter, after having been displaced out of engagement with said cylindrical member slot by said plunger, back into engagement with said slot each time, and upon said slot being brought into alignment with said sleeve means opening, while said cylindrical member is in a quiescent state.

25. A terminal-receiving and wire wrapping assembly in accordance with claim 22 further including actuable switch means positioned on said sleeve means so as to be responsively actuated by the displacement of said locking member out of the slot of said cylindrical member.

26. A terminal-receiving and wire wrapping assembly in accordance with claim 22 further comprising an adjustable locking member housing secured to the outer wall of said sleeve means, said housing member having a laterally extending boss formed with an aperture adapted to receive and guide the reciprocally displaceable locking member.

* * * * *